US007757416B2

(12) United States Patent
Shearrow et al.

(10) Patent No.: US 7,757,416 B2
(45) Date of Patent: Jul. 20, 2010

(54) PORTABLE AND STOWABLE QUILTING DESIGN WALL

(76) Inventors: Kim Shearrow, 22319 Bryton Dr., Powell, OH (US) 43065; Mary Montgomery, 530 Dendra La., Worthington, OH (US) 43085

( * ) Notice: Subject to any disclaimer, the term of this patent is extended or adjusted under 35 U.S.C. 154(b) by 735 days.

(21) Appl. No.: 11/786,613

(22) Filed: Apr. 12, 2007

(65) Prior Publication Data

US 2007/0243784 A1 Oct. 18, 2007

Related U.S. Application Data

(60) Provisional application No. 60/792,513, filed on Apr. 17, 2006.

(51) Int. Cl.
*D06C 3/00* (2006.01)
*A47F 5/08* (2006.01)

(52) U.S. Cl. ..... 38/102.91; 211/87.01

(58) Field of Classification Search ..... 112/439, 112/99, 117, 119, 470.14, 475.08, 475.22; 206/449; 211/87.01
See application file for complete search history.

(56) References Cited

U.S. PATENT DOCUMENTS 4,949,415 A * 8/1990 Selga ..... 5/502
5,540,609 A * 7/1996 Hoag ..... 446/26
5,650,211 A 7/1997 Randolph
5,665,448 A 9/1997 Graham et al.
6,371,285 B1 * 4/2002 DuBois ..... 206/6.1
6,862,823 B2 4/2003 deCarteret
2004/0124116 A1 * 7/2004 Long ..... 206/581
2004/0163295 A1 * 8/2004 Fontana et al. ..... 40/617
2006/0037874 A1 * 2/2006 Mitchell ..... 206/225
2006/0113264 A1 * 6/2006 Ferber et al. ..... 211/87.01
2008/0185946 A1 * 8/2008 Meckert et al. ..... 312/259

* cited by examiner

*Primary Examiner*—Ismael Izaguirre
(74) *Attorney, Agent, or Firm*—Ronald J. Koch

(57) ABSTRACT

A portable and stowable quilting wall has generally rectangular body composed of a smooth backing sheet sewn peripherally to a mating front sheet of heavy nap felt. A top hem mounts spaced pieces of hook fasteners interspersed with holes. A bottom hem confines a heavy rod, while the backing sheet mounts strips of loop fasteners that are spaced to engage the hook fasteners when the wall is rolled up on itself to retain the quilting wall in a rolled-up condition for easy movement and storage. The felt nap releasably engages pieces of quilt pieces placed and retains them in both rolled-up and unrolled conditions, without the use of added adhesive or mechanical fasteners. The holes in the top hem receive hooks to hang the unrolled sheet against a wall or door, while the rod maintains the quilting wall flat against a vertical surface.

6 Claims, 4 Drawing Sheets

PORTABLE AND STOWABLE QUILTING DESIGN WALL

RELATED APPLICATION

This application claims priority of U.S. Provisional Patent Application Ser. No. 60/792,513, filed Apr. 17, 2006.

TECHNICAL FIELD

This invention relates to an aid for quilters and, more particularly, to a quilting design wall which is easily portable and stowable.

BACKGROUND OF THE INVENTION

Quilting is a fast growing and popular craft in the U.S. and throughout the world. Quilters spend hours creating quilts that often have complex and intricate designs and patterns, amounting to works of art. Quilters use many methods and aids to assist them in laying out these patterns, which comprise many pieces of varying sizes. These aids are generically referred to as "design walls". One of these uses a piece of flannel or felt laid on a table top, frequently the family dining table. The felt and flannel helps hold the quilt fabric pieces, called "blocks", from sliding out of place as various designs are tried out. The blocks can easily be removed and placed in a different position, as the quilter seeks a desirable pattern. This method has the disadvantage of requiring removal from the table top when there is need to use the table for other uses. The creation of a quilt pattern can take hours or days, depending on complexity.

These felt or flannel pieces are also tacked onto a wall, since the felt and flannel have the ability to hold the blocks on the vertical surfaces, due to the heavy nap of the felt or flannel. However, since most quilters do not have a dedicated quilting room, common rooms, such as a bedroom or dining room, are used and this new wall adornment is not a part of the room decor and must be moved frequently. Sometimes, the felt or flannel piece is nailed onto a door or door frame. However, this is a short-term mounting if the door is ever to be used, as is usual, for passage in a house or apartment.

When moving these felt or flannel "design walls", whether installed horizontally or vertically, great care must be taken to not disturb the blocks in the design layout already accomplished.

Thus, there is a need for some type of quilting design wall that is easy to use, store and transport. One solution to this problem is posed in U.S. Pat. No. 6,862,823—deCarteret, wherein a piece of fabric is coated on both sides with a dry tack adhesive. This enables the fabric to be removably adhered to a wall on one side and to adhere fabric pieces on the other side. A cover sheet is placed over the fabric pieces to enable the sheet to be rolled up for movement. This device, which is commercially available as the "Block Butler", suffers from several serious shortcomings. The dry tack adhesive is affected by humidity level and must be spritzed with a water spray if the humidity drops, or the quilt fabric pieces fall off. Also, it has been found that, in any humidity, the pieces will not adhere overnight. A further drawback is that, when pieces are removed, the adhesive trends to retain loose threads, and attracts lint and animal hair that is difficult to remove.

In view of the above, there is a need for a quilting design wall that is easy to mount, remove, store and transport while retaining the quilting pattern as it progresses. It is further need for a quilting design wall that easily and securely, yet easily removably, mounts quilting blocks.

SUMMARY OF THE INVENTION

Accordingly, it is an object of this invention to provide a quilting design wall that is easy to mount, remove, store and transport while retaining the quilting pattern as it progresses.

It is another object of this invention to provide a quilting design wall that easily and securely, yet removably, mounts quilting blocks.

In one aspect this invention features a quilting design wall for temporarily mounting quilting blocks that comprises a body having a mounting sheet on the front side and a backing sheet on the back side and secured together peripherally. The mounting sheet comprises a heavy nap felt or flannel material. The backing sheet is preferably a soft flat nap fabric. A stiff rod is sewn into a pocket extending laterally of the body at its bottom. The body includes a plurality of spaced mounting holes across its top. The holes facilitate removably mounting of the body on hooks or nails extending from a wall or door frame. The rod serves a dual purpose—to weight the bottom so that the body hangs straight and flat, and as an aid to initiate tightly rolling up of the body into a compact roll for ease of transport or storage, while retaining the blocks in the pattern as developed. Cooperable fasteners (preferably hook-and-loop type) are attached at spaced points at the top of the body and near the top on the back to secure the body in its rolled-up condition.

Retention of the blocks in the developed pattern is aided by the material of the back, which is smooth and does not attach to the flannel, or to the blocks. The front material could also be a heavy nap felt, while the back material can be curtain backing material. A handle could be secured at the middle of the top to aid in carrying.

These and other objects and features of this invention will become more readily apparent upon reference to the following detailed description of a preferred embodiment, as illustrated in the accompanying drawings, in which:

DESCRIPTION OF THE PREFERRED EMBODIMENT

Figure 1:
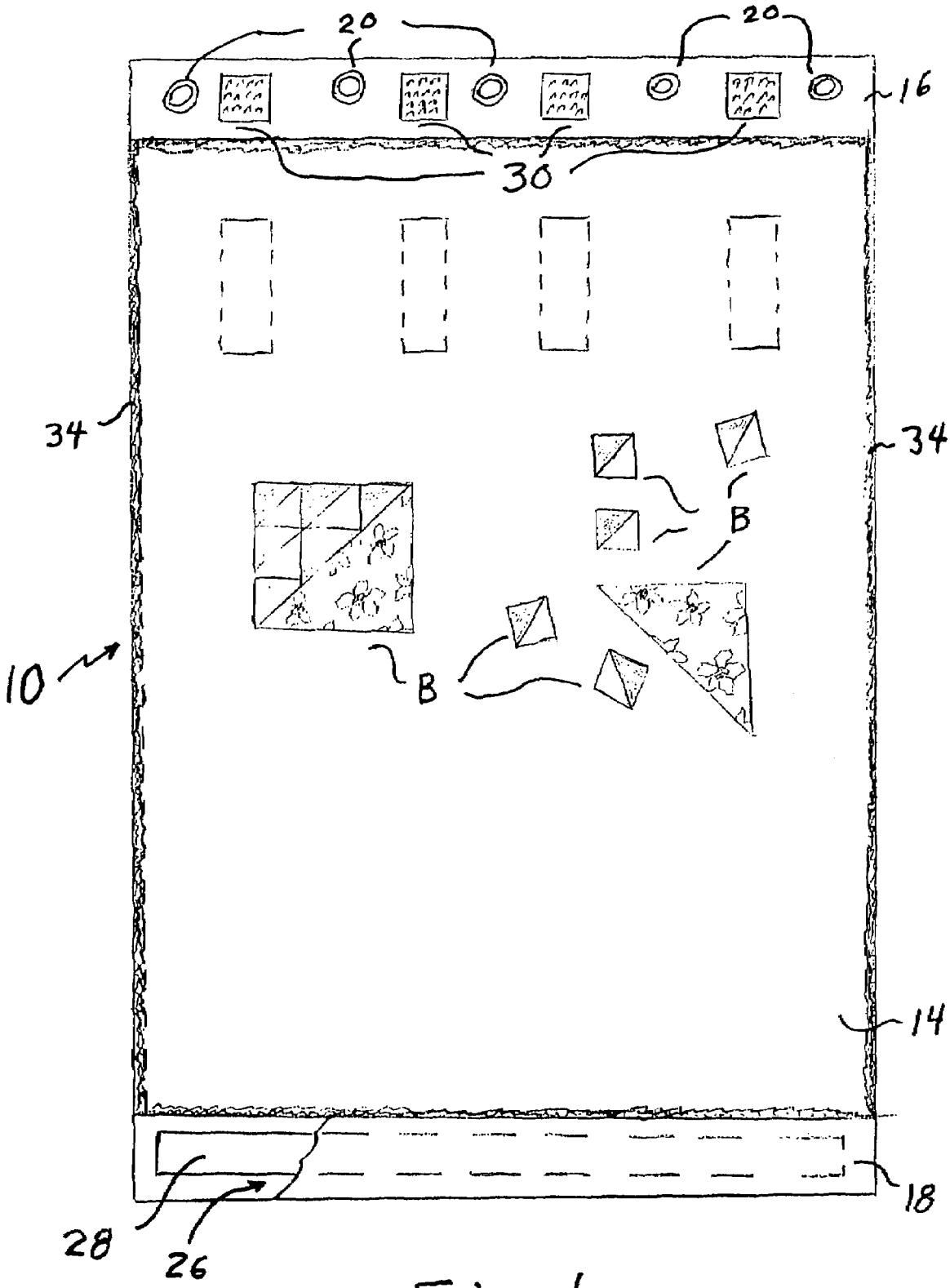
FIG. 1 is a front perspective view of a quilting design wall according to this invention; shown open and hanging; with the bottom hem partially broken away.
Figure 2:
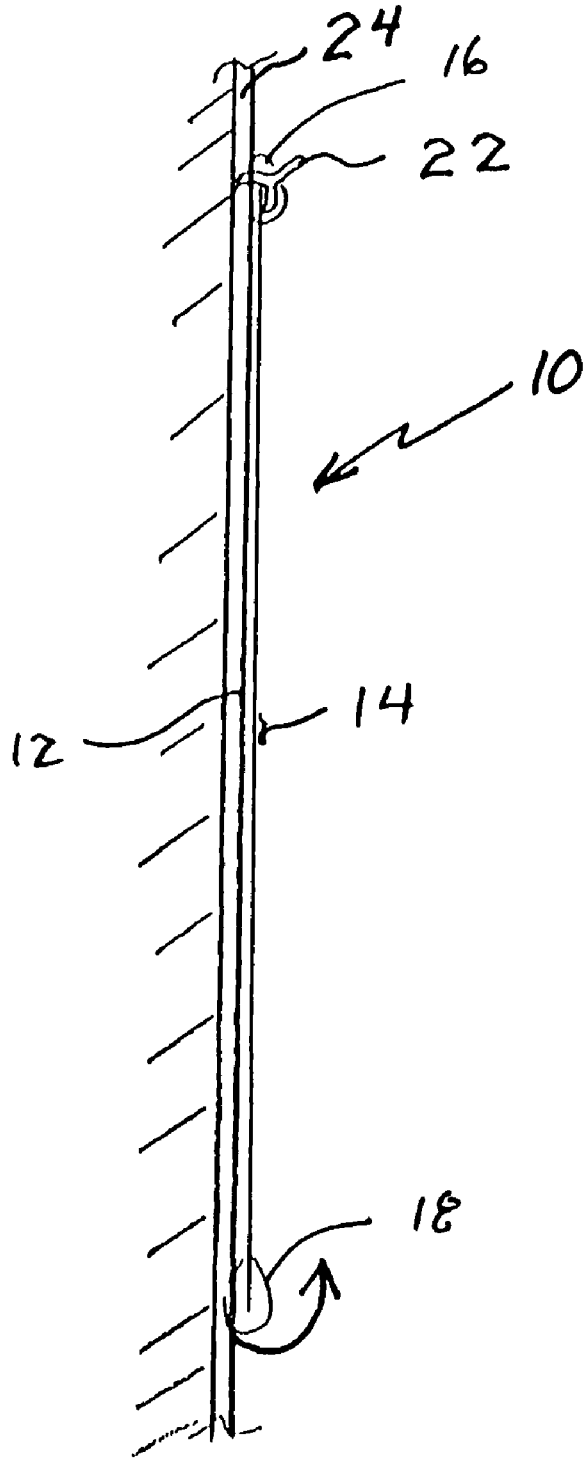
FIG. 2 is a side view of the quilting design wall of FIG. 1.
Figure 3:
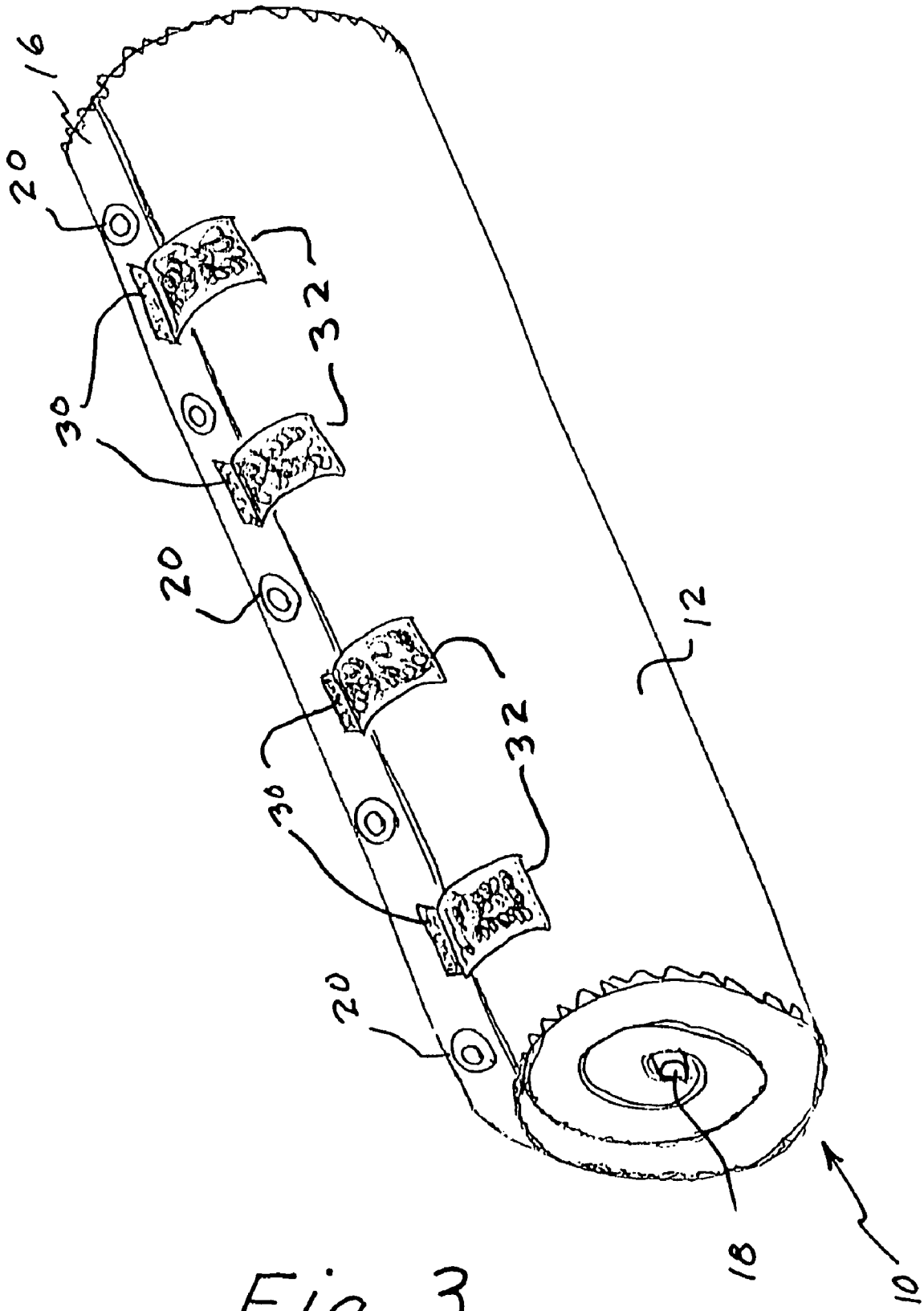
FIG. 3 is a perspective view of the quilting design wall of FIG. 12, shown in rolled condition.

As shown in the drawing FIGS. 1 and 2, a quilting design wall has a body 10 comprising a backing sheet 12, preferably made of a curtain backing material or equivalent having a smooth outer surface and a front sheet 14, preferably made of a heavy nap flannel. Backing sheet 12 overlaps front sheet 14 about its periphery and the sheets are peripherally sewn together, as illustrated. This creates an upper hem 16 and a lower hem 18.

A plurality of grommets 20 are positioned across the upper hem 16 to provide holes for receiving hooks 22 or other projections for mounting to a wall 24, as shown in FIG. 2. A pocket 26 is formed in lower hem 18 to receive a weight, such as a wood or other material rod 28 extending across the bottom of body 10 to provide a weight so that body 10 hangs straight and flat against wall 24, as shown in FIG. 2. When hung, body 10 is ready for mounting of quilting fabric, or blocks B on front sheet 14.

Figure 4:
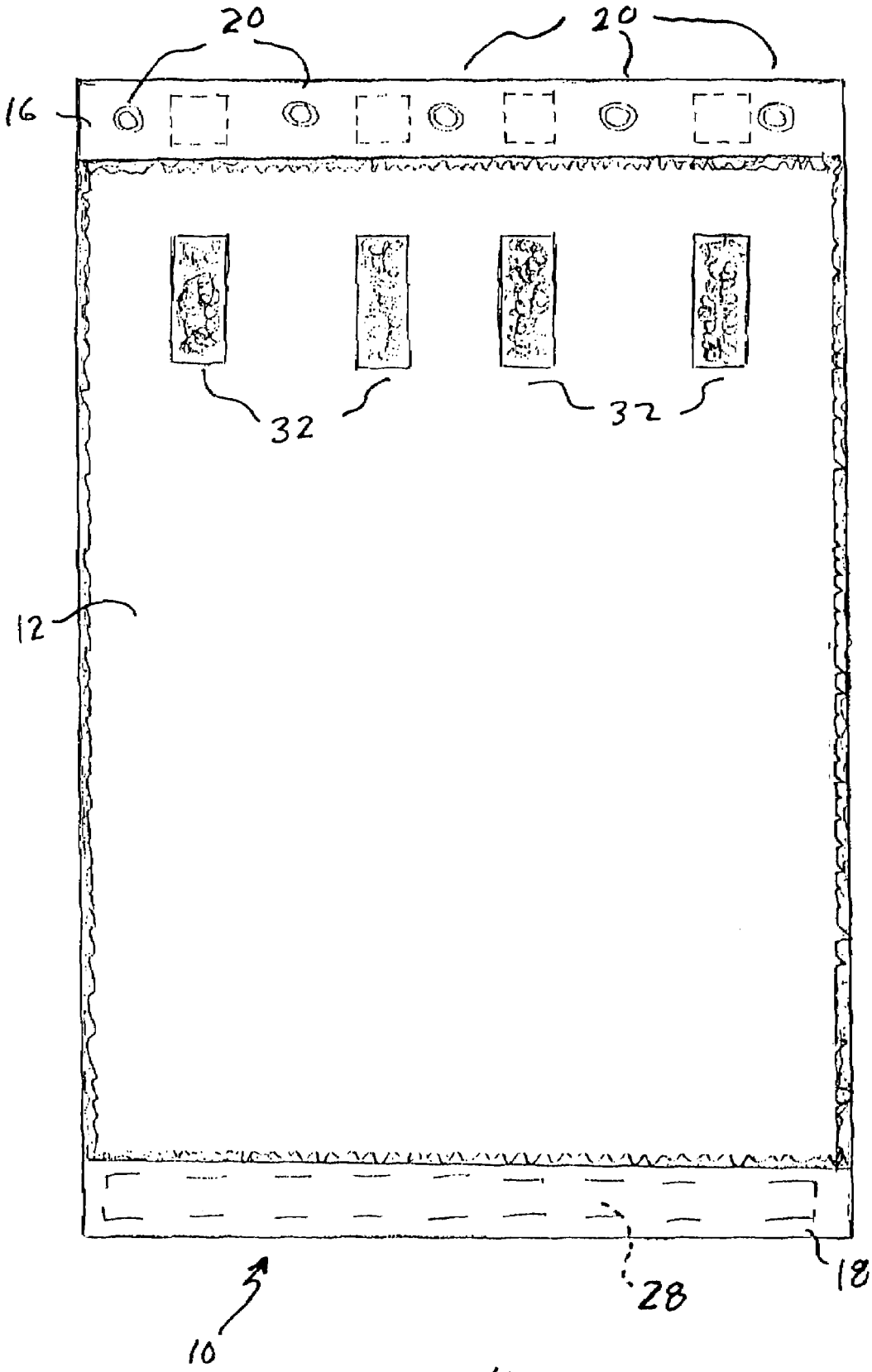
FIG. 4 is a rear view of the quilting design wall.

Pieces of hook material 30 are spaced across top hem 16 between grommets 20. As shown in FIG. 4, elongated pieces of loop material 32 are positioned near the top of backing sheet 12 and positioned to engage with the cooperating pieces of hook material 30 when body 10 is rolled up. It is preferable to place loop material 32 on backing sheet 12 so as not to scratch wall 24 or other vertical mounting surface. Strips 32 are elongated as compared to hook material pieces 30 to accommodate various thicknesses of body 12, due to varying quantities of blocks B attached to front sheet 14, when it is rolled up.

A quilter need only provide nails or hooks on a wall, door frame, door, or other mounting surface, and quickly and easily hang body 10, as needed. In addition, S-shaped hooks that fit over the top of a door can be used to hang body 10. The peripheral stitching of the backing material 12 produces a peripheral fold 34 at the sides, which is useful as a "pin border" for holding straight pins, often used by quilters in laying out designs.

When quilting layout work is completed or needs to be interrupted, the quilter merely grabs lower hem 18 and its contained rod 28 and rolls inwardly over the front sheet and upwardly until hooks 22 are encountered. The rolled body 10 is then removed from the hooks and a quarter turn roll is all that is needed to engage the cooperating hook-and-loop fasteners 30 and 32 to secure quilting wall body in the rolled-up condition. The rolled-up body 10 can then be easily transported and stored. By tightly rolling body 10, blocks B are retained in their positions, ready for the next design session. When the quilter desires to resume work on the quilt, fasteners 30 and 32 are disengaged and body 10 is easily unrolled and re-hung on hooks 22 or other hangers.

Quilts were originally developed to utilize scrap fabric to make a useful warm bed covering. As the art of quilting progressed, the designs became more intricate and complex, creating artistic designs that more resembled tapestries in artistic merit. These artistic quilts are often displayed as wall hangings, rather than bed coverings. As such, they do not need the backing and intermediate batting which supplied the warmth for a bed covering. It is now becoming more fashionable to make a quilt top as a purely artistic wall hanging to be displayed it alone, without the backing and batting. However, if the top is displayed alone, it doesn't have sufficient substance or body to hang flat. Thus, the quilt top must be fastened to the wall or to some sort of frame by fasteners, such as pins. This is a clumsy and inefficient way to mount the quilt top, because it is semi-permanent and cannot easily be moved.

The quilting design wall of this invention provides a convenient means of displaying a quilt top or piece thereof. The top is just pressed flat against the nap of the front sheet 14 and the nap, contacting and engaging such a large surface, will hold the quilt top in place, just as it does with the fabric blocks B, without the use of adhesive, pins or other fasteners. In this manner, a quilt top can be easily removed by peeling it off the nap of the front sheet 14 of the quilting wall body 10 and quickly replaced by another quilt top of different design, as easily as changing a picture on a wall. Alternatively, if it is desired to only temporarily remove the mounted quilt top, the body may quickly removed from the hooks and rolled up as described above.

While only a preferred embodiment has been described and shown, obvious modifications are contemplated within the scope of this invention. For example, hooks 22 need not be permanent, but can be of the removable type, such as the "Command" strips marketed by 3M Company. Use of such removable strips would enable the use of this portable and stowable quilting wall on any wall in the house without marring the decor. Also, body 10 can be hung over a door by using S-shaped hooks, further enhancing the versatility of use of the quilting wall according to this invention. Also, the hook-and-loop fasteners 32, 34 could be replaced by snaps or any other cooperable fasteners.

We claim:

1. A quilting wall, comprising a generally rectangular backing sheet and a mating front sheet attached thereto, said sheets together having top, bottom, left and right edges, a hem formed along the top edge, extending from the left edge to the right edge, a plurality of first fasteners spaced across the top edge, a hem formed along the bottom edge, a weighted rod carried by the bottom hem, and a plurality of second fasteners spaced across the backing sheet adjacent the top hem and spaced so that each cooperably engages one of said first fasteners when the quilting wall is rolled up on itself over the front sheet to retain the quilting wall in a rolled-up condition, wherein said front sheet has a nap formed thereon for releasably engaging quilt pieces placed thereon and retaining them in both rolled-up and unrolled conditions, said nap being able to retain said quilt pieces without added adhesive or mechanical fasteners, said backing sheet having a smooth surface so as to not disturb the quilt pieces when the quilting wall is rolled up and unrolled, and hanging means carried by said top hem for hanging the unrolled quilting wall in vertical orientation adjacent a vertical surface.

2. The quilting wall of claim 1, wherein the first and second fasteners are cooperable hook-and-loop fasteners.

3. The quilting wall of claim 1, wherein the hanging means are spaced holes in the top hem for receiving mounting hooks.

4. The quilting wall of claim 1, wherein the material is heavy nap felt.

5. The quilting wall of claim 1, wherein the material is flannel.

6. The quilting wall of claim 1, wherein the top, bottom and both side edges are stitched together to secure the front sheet to the backing sheet, thus creating a peripheral pin border for receiving pins.

* * * * *